United States Patent [19]

Greer

[11] 4,011,976

[45] Mar. 15, 1977

[54] METHOD AND SYSTEM FOR CONTROLLING WEB SPEED

[75] Inventor: Thomas Marion Greer, Brevard, N.C.

[73] Assignee: E. I. Du Pont de Nemours and Company, Wilmington, Del.

[22] Filed: Oct. 15, 1975

[21] Appl. No.: 622,675

[52] U.S. Cl. ..... 226/8; 226/42; 226/44; 226/117

[51] Int. Cl.[2] ..... B65H 25/04

[58] Field of Search ..... 226/1, 8, 42, 43, 44, 226/117

[56] References Cited

UNITED STATES PATENTS

| | | | |
|---|---|---|---|
| 3,045,360 | 7/1962 | Alexeff | 226/44 X |
| 3,087,663 | 4/1963 | Anderson | 226/44 |
| 3,613,975 | 10/1971 | Knight | 226/42 X |
| 3,724,733 | 4/1973 | Schaffer | 226/44 X |

*Primary Examiner*—Richard A. Schacher

[57] ABSTRACT

A method and apparatus to reduce ripple in the signal produced by a transducer attached to a dancer roll, or web accumulator, where cyclic web motion is present. Two transducers are used, one to produce a dancer roll position signal, and another, responsive to the cyclic web drive, to produce a signal corresponding to the ripple component of the dancer roll position signal. An adder combines both signals to generate a third, ripple free signal indicative of the average dancer roll position in the web accumulator. This ripple free signal may be used to control the web speed.

10 Claims, 3 Drawing Figures

METHOD AND SYSTEM FOR CONTROLLING WEB SPEED

BACKGROUND OF THE INVENTION

1. Field of the Invention

This invention relates to web transports and, more particularly, to a method and apparatus for controlling the speed of a web.

2. Description of Prior Art

In the production of discrete sheet material from a continuous web, it is often necessary to momentarily stop the advance of the web sufficiently long to effect a cut across its width, an operation often referred to as chopping. It is, however, undesirable, and usually impractical to interrupt the web motion all along the web length since a number of upstream operations, such as casting, coating, printing or simply unrolling, etc. occur on a continuous basis. Therefore, it is usual to provide for a web accumulation section, which in its simpler form may comprise just one dancer roll loop having a dancer roll between the chopper and the output from the last operation on the web which requires continuous feed. So long as the average amount of web withdrawn from the accumulator by the intermittent motion on the output side, equals the amount introduced in the accumulator by the continuous feed, the operation of the chopper will not interfere with the upstream motion of the web.

To obtain the synchronization necessary between the web sections, it is known to employ speed controls which often rely on the position of the dancer roll to detect any mismatch between the demand and supply of web to that section.

As the web movement in the chopper section is stopped for the cutting operation, the dancer roll descends to accommodate the incoming web from the upstream side by increasing the path length of the web within the web accumulator. When web movement resumes in the chopper section, the web is taken out of the web accumulator at a faster rate than the input feed and the dancer roll ascends. A position transducer connected to the dancer roll generates a cyclic electrical signal having a direct component representative of the average dancer roll position, on which is superimposed an alternating component known in the art as "ripple"; this latter component represents the instantaneous position of the dancer roll around its average position. The ripple is undesirable in speed control systems, as it tends to continuously adjust the feed speed to compensate for the instantaneous variations of the dancer roll position.

A mechanical system with large backlash between the transducer and the dancer roll is sometimes used to minimize the ripple transmitted to the transducer. In the alternative, heavy electrical filtering on the output of the transducer may be employed to reduce the alternating voltage component of the generated signal. Neither approach provides an ideal solution as both introduce considerable delay in the system response, which results in instability problems in the related feed control.

While not specifically designed for web transport systems, it is also known in the art to remove ripple from a direct current using inverse feedback as shown in U.S. Pat. No. 3,474,349. This method requires the use of an amplifier with an electronic feedback to invert and amplify the alternating component only, of the output signal which is then reintroduced in the main amplifier input to diminish the ripple. The disadvantage of this approach is the feedback is not actually related to actual web movement and can produce false control signals.

Accordingly, it is an object of this invention to obviate many of the disadvantages of the prior art web speed control systems. Another object of this invention is to provide a simple method and apparatus for reducing ripple in the output of a transducer indicating the position of a dancer roll in a web transport system.

SUMMARY OF THE INVENTION

According to a preferred embodiment of this invention, the speed of a web in a web transport, having a dancer roll and both continuous and intermittent drives, is controlled utilizing the average position of the dancer roll by the steps of: generating a first signal having unidirectional and bidirectional components corresponding to the instantaneous position of the dancer roll, generating a second signal having a bidirectional component related to the web movement produced by said intermittent drive, algebraically combining said first and second signals to produce a resultant signal with a reduced bidirectional component, and controlling the continuous drive with the resultant signal thereby to control the speed of the web.

This method may be performed using a preferred system constructed according to the invention. This preferred system includes sensor means for providing a first signal having unidirectional and bidirectional components corresponding to the instantaneous position of the dancer roll, transducer means for providing a second signal having a bidirectional component related to the web movement produced by the intermittent drive, adder means for algebraically combining the first and second signals to provide a resultant signal having a reduced bidirectional component that is indicative of the average position of the dancer roll, said continuous drive being responsive to the resultant signal for adjusting the speed of the web.

This method and system provide a more positive control over web speed that is substantially unhampered by the usual ripple components present in many dancer transducer signals. Such ripple components are deleterious to effective web speed control.

BRIEF DESCRIPTION OF THE DRAWINGS

Further advantages and features of this invention will become apparent upon consideration of the following description wherein.

DESCRIPTION OF THE PREFERRED EMBODIMENT

Figure 1:
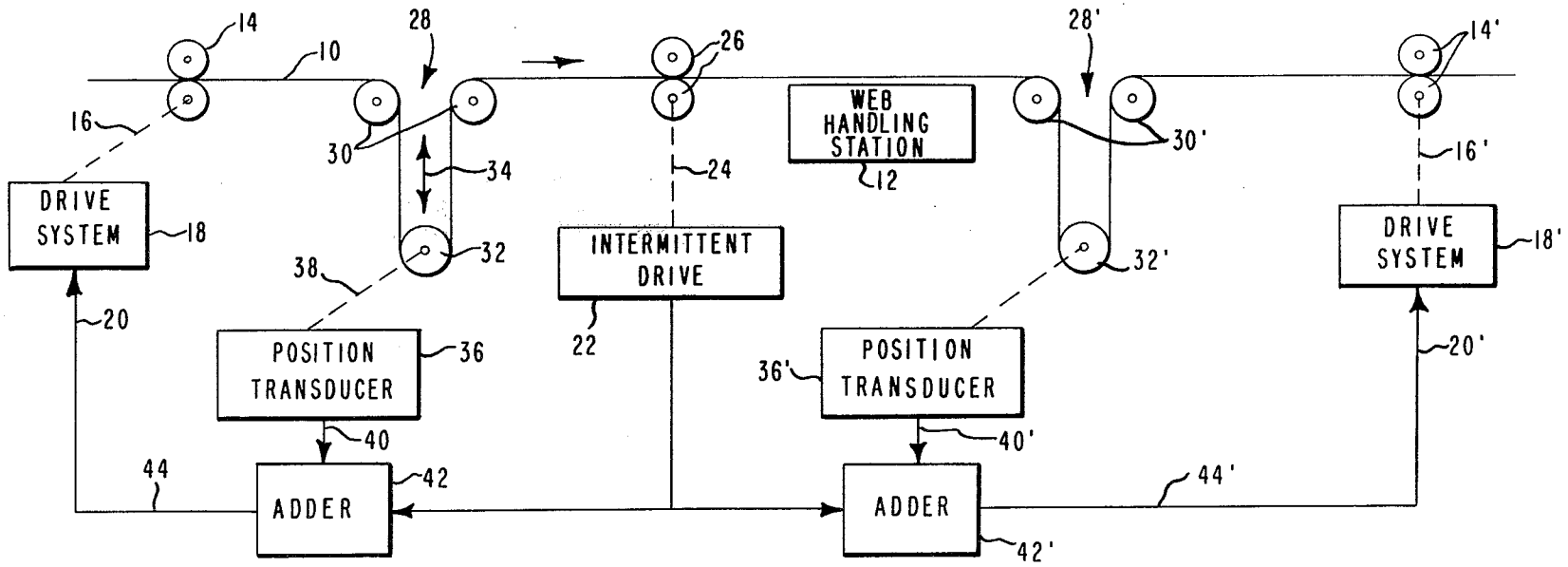
FIG. 1 is a block diagram showing the preferred web speed control system of this invention.

There may be seen with reference to FIG. 1 a typical web transport system, which is subject to intermittent movement at a portion thereof, using a web accumulator to compensate for such intermittent speed variations. In this drawing the web 10 may be considered as any long strip of sheet like material such as photographic film, magnetic tape, metal, paper and the like. Alternatively, the web 10 may be a strand. As this strip, strand or web 10 is moved it is often subjected to particular operations such as printing, cutting and the like at some point. This point is depicted by the block 12 labeled web-handling station. It may be assumed, by way of example, that this web-handling station 12 is a conventional chopper which segments the strip material into several sheets. To accomplish this, the web 10 is driven by a pair of pinch rolls 14 coupled by a suitable mechanical linkage, depicted by the dotted line 16, to a conventional drive system 18 which may incorporate a servo motor whose speed is controlled in accordance with a control signal applied at its input 20.

The web is intermittently fed to the chopper or web-handling station 12, as noted. This is accomplished by an intermittent drive which includes a suitable motor and other control equipment, depicted by the block 22, operating through a suitable mechanical linkage 24 to drive pinch rolls 26. To accommodate these intermittent advances of the web without stretching or permitting the web to wrinkle or fold upon itself, a web accumulator 28 is used. The accumulator 28 includes the pair of idler rolls 30 and a so-called dancer roll 32, which is in effect floating and free to move up and down as depicted by the arrows 34 to provide a greater or lesser length of web between the idler rolls 30.

In accordance with this invention, the position and movements of the dancer roll 32 are sensed by a position transducer 36 which is coupled to the dancer roll 32 by a suitable mechanical linkage depicted by the dashed line 38. The position transducer 36, which may be a conventional transducer such as a linear voltage differential transformer, thus provides an electrical signal corresponding to the instantaneous position of the dancer roll. Since the dancer roll moves upwardly and downwardly relative to an average center position, this transducer signal may be seen to contain both a unidirectional component representative of dancer mean position and a bidirectional component representative of the instantaneous movements of the dancer roll. The latter may be considered undesirable ripple on the desired mean position component.

This dancer roll signal is supplied through the line 40 to an adder 42. A second signal is also supplied to the adder 42 which is representative of the movements of the intermittent drive 22. Ideally, the second signal is contrived to be the inverse of the dancer signal's bidirectional component under the ideal, speed-matched condition. This signal may be derived either from the control signals which actuate the servo motor in the intermittent drive or by a transducer directly coupled to the mechanical linkage 24 which drives the rolls 26 themselves. In any event, this signal is bidirectional and is also applied to the adder 42 as noted. The adder 42 algebraically adds the two signals (actually subtracts the intermittent drive signal if it is not of the inverse polarity) from the dancer roll signal on line 40 such that the output of the adder provides a resultant signal on line 44 having a substantially reduced or eliminated bidirectional component. In effect then, the so-called ripple (produced by the upward and downward departures of the dancer roll from its mean position) has been eliminated or reduced in amplitude, leaving a resultant signal which represents the dancer's mean position, substantially free of these ripple components. These bidirectional or ripple components, if present, render it difficult for the constant speed drive section to run at constant speed.

This resultant signal 44 is connected to the input 20 of the drive system 18 to vary the speed of the web 10 in accordance with the average position of the dancer roll 32 and operates to increase or decrease the speed of the web as required to maintain the dancer roll mean position approximately at a central point. The dancer roll may either rise or fall to accommodate less or more web material as required.

Figure 2:
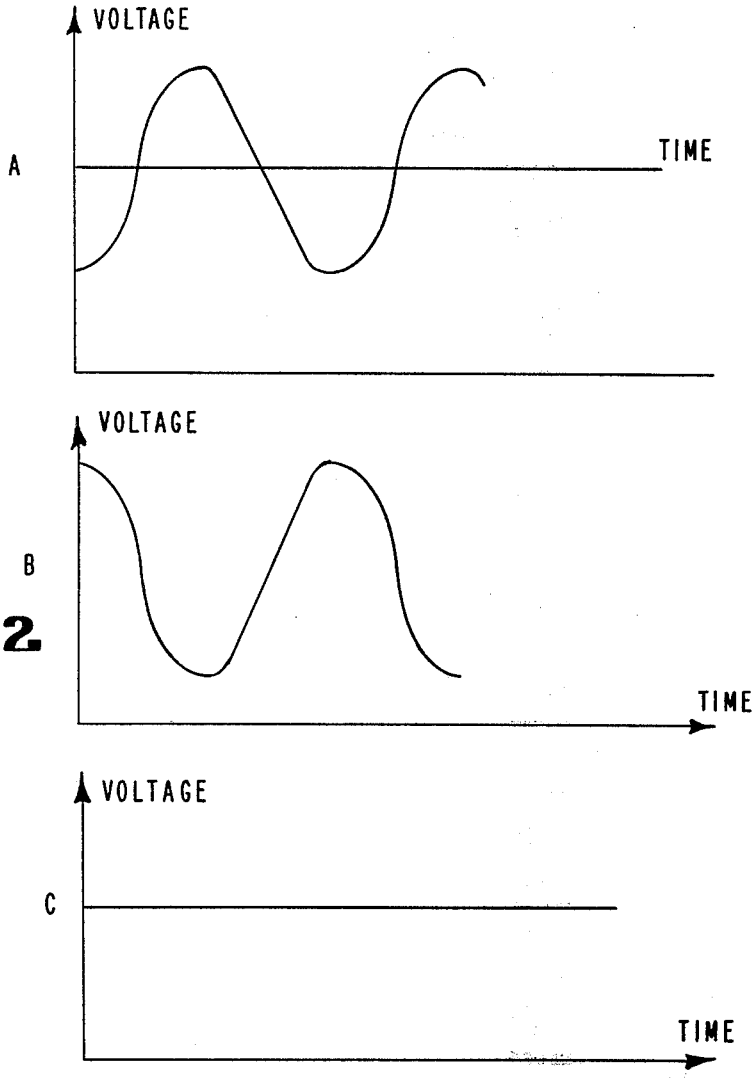
FIG. 2 shows typical plots of the various control signals vs. time which are used in the method of this invention and in the system illustrated in FIG. 1.

These output waveforms are illustrated in FIG. 2 in which the first waveform A is seen to correspond to the dancer signal on line 40 and has both direct and alternating components. The second waveform B is seen to correspond to the signal derived from the intermittent drive 22 and is seen to comprise primarily alternating components. When the intermittent signal is subtractively summed with the dancer signal, the resultant signal depicted by waveform C is seen to be a steady direct signal which varies in amplitude as the average position of the dancer roll 32 varies. Such signal provides a stable control signal which may be used to control the drive system 18.

In an alternative embodiment, vagaries in the movement of the dancer roll 32' in a system wherein the web is subjected to intermittent motion by the intermittent drive 22, but is not chopped also is depicted in FIG. 1. By way of example, the web may be subjected to some printing operation or the like. In this instance, a further web accumulator 28' may be used downstream of the "web-handling station" to control a downstream drive system 18' which operates through the mechanical linkage 16' to control the drive rollers 14'. In this instance, the downstream drive control system is operated simultaneously with the upstream drive system. Except for sense inversions required, the operation is substantially identical to that previously described and the primed (') elements are substantially the same as the unprimed elements.

Figure 3:
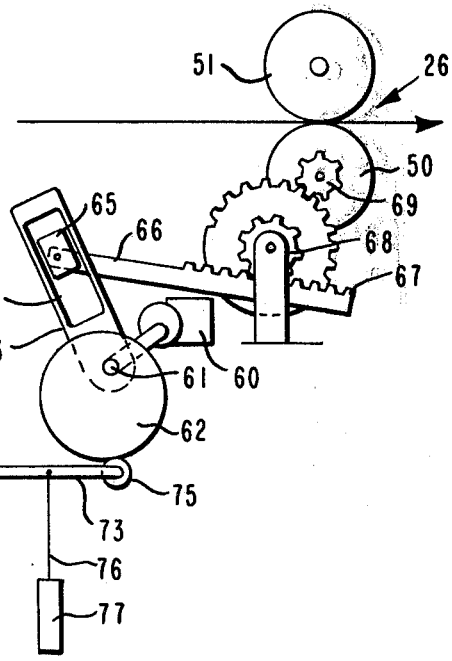
FIG. 3 shows the details of a portion of the speed control system constructed in accordance with the preferred embodiment illustrated in FIG. 1.

In FIG. 3 the details of a preferred apparatus for providing the intermittent signal corresponding to the intermittent movements of the drive system is shown. Thus, in FIG. 3, the web 10 is driven by the intermittent drive rolls 26 in which the lower or drive roll 50 contacts the web which is pressed therebetween by a pinch roll 51.

A typical apparatus for providing such intermittent advance is by means of a motor 60 driving a crankshaft 61 at a constant speed. On the crankshaft 61 there is mounted a crank arm 63 having an elongated slot 64. A block 65, adjustably secured within the slot 64, movably attaches a connecting rod 66 terminating in a linear gear 67. The adjustable block 65 serves to establish the length of the web transported per revolution of the crank arm. The geared portion of the connecting rod 66 engages a double gear 68. This double gear 68 engages, in turn, a gear 69 which is attached to the pinch roll 50 and is clutched and can rotate the pinch roll 50 in one direction only. For simplicity, the clutching arrangement has been omitted from the drawing. The connecting rod 66 forces an oscillatory rotation of double gear 68. Due to the action of the overrunning clutch (not shown), clockwise motion is imparted to pinch roll 50 for about 50% of the cycle time. Pinch roll 50 is then at rest for the remainder of the cycle time.

Also mounted on the crank shaft 61 is an eccentric cam or wheel 62. On this eccentric wheel rides a cam follower 75 which is mounted on an arm 73 which, in turn, is pivoted on a support 74. Attached to the arm 73 is a linkage 76 which drives a position transducer 77.

In a typical circuit, both transducers may be linear variable differential transformer (LVDT) types, such as No. P/N L602-1.00 manufactured by Kavlico Electronics. Typically, they provide for a ± 1 inch (2.54 cm) stroke and operate with an input supply of 6 volts DC to generate 5 volts DC per inch of displacement.

Other transducers may be used without changing the scope of this invention. Thus the transducers may be pneumatic in which case fluidic signals may be used, or optical in which case either electrical or light signals may be used.

The adder may be a resistive network and may include buffer amplifiers such as an operational amplifier, Type 747 made by Fairchild Semiconductor Co.

In the operation of this preferred embodiment, illustrated in FIG. 3, the eccentric wheel 62 is fixed on crankshaft 61 so that the "de-ripple" signal produced at the output 40 will be in opposition to the bidirectional component of the signal produced by transducer 36 (FIG. 1). An adjustable resistor can be used to adjust the magnitude of the outputs, if required. The two signals, the de-ripple signal and the dancer signal, are added to produce a practically ripple free electrical control signal which represents the position of the dancer roll, shown in FIG. 2, as noted previously.

The eccentric wheel 62 is mounted on the crankshaft 61 to simply and effectively synchronize the ripple voltage generated by the dancer roll transducer and the de-ripple voltage produced by transducer 77. Since the average speed of the web leaving the accumulator is constant, the average position of the dancer roll is directly dependent on the speed of the web entering the accumulator. This upstream speed is ultimately controlled by the de-rippled dancer signal, acting as a speed reference for the upstream drive section. When the web is pulled by pinch rolls 26, dancer roll 32 rises as the web picks up speed. When the web is stopped, dancer roll 32 descends in the accumulator. Since the eccentric wheel 62 is fixed on the crankshaft 61, synchronization of the two electrical signals is automatic regardless of web feed through speed changes. The operation of the downstream drive system 18', when used, is substantially the same as that just described and provides a relatively constant web speed at the output.

There thus has been described a relatively simple control system for a web which is able to compensate for the bidirectional movements of a dancer roll and thereby provide a more suitable, better utilized control signal for controlling web speed.

I claim:

1. A method of controlling the speed of a web in a web transport, having a dancer roll and both continuous and intermittent drives, utilizing the average position of the dancer roll comprising the steps of:

generating a first signal having unidirectional and bidirectional components corresponding to the instantaneous position of said dancer roll, generating a second signal having a bidirectional component related to the web movement produced by said intermittent drive, algebraically combining said first and second signals to produce a resultant signal indicative of the average position of said dancer roll, and controlling said continuous drive with said resultant signal, thereby to maintain the speed of said web relatively constant.

2. A method according to claim 1 wherein the step of generating a first signal includes sensing the position of said dancer roll.

3. A method according to claim 2 wherein the step of generating a second signal includes sensing the movement of said intermittent drive.

4. A method according to claim 1 wherein said continuous drive is downstream of said intermittent drive.

5. A method according to claim 1 wherein said continuous drive is upstream of said intermittent drive.

6. A system for controlling the speed of a web in a web transport having a dancer roll and both continuous and intermittent drives using the average position of said dancer roll comprising, in combination, sensor means for providing a first signal having a unidirectional and a bidirectional component corresponding to the instantaneous position of said dancer roll, transducer means for providing a second signal having a bidirectional component related to the web movement produced by said intermittent drive, adder means for algebraically combining said first and second signals to provide a resultant signal having a reduced bidirectional component that is indicative of the average position of dancer roll, and said continuous drive responsive to said resultant signal for maintaining the speed of said web constant.

7. A system according to claim 6 wherein said sensor means is responsive to the physical position of said dancer roll.

8. A system according to claim 7 wherein said transducer means is responsive to the movement of said intermittent drive.

9. A system according to claim 6 wherein said intermittent drive includes a cam operatively connected thereto, said transducer means includes a cam follower associated with said cam and responsive thereto to provide said second signal.

10. A system according to claim 9 wherein said sensor means is responsive to the physical position of said dancer roller and wherein said transducer means is responsive to the movement of said intermittent drive.

* * * * *